US006263971B1

(12) United States Patent
Giannesini

(10) Patent No.: US 6,263,971 B1
(45) Date of Patent: Jul. 24, 2001

(54) MULTIPHASE PRODUCTION SYSTEM SUITED FOR GREAT WATER DEPTHS

(75) Inventor: Jean-François Giannesini, Saint-Cloud (FR)

(73) Assignee: Institut Francais du Petrole, Rueil-malmaison cedex (FR)

( * ) Notice: Subject to any disclaimer, the term of this patent is extended or adjusted under 35 U.S.C. 154(b) by 0 days.

(21) Appl. No.: 09/343,217

(22) Filed: Jun. 30, 1999

(30) Foreign Application Priority Data

Jun. 30, 1998 (FR) ..... 98 08374

(51) Int. Cl.[7] ..... E21B 29/12

(52) U.S. Cl. ..... 166/366; 166/350; 405/224.2; 405/224.3

(58) Field of Search ..... 166/350, 366, 166/368; 405/195.1, 203, 210, 224, 224.2, 224.3

(56) References Cited

U.S. PATENT DOCUMENTS

| | | | | |
|---|---|---|---|---|
| 3,572,041 | * | 3/1971 | Graaf | 405/205 |
| 4,147,221 | * | 4/1979 | Ilfrey et al. | 166/367 X |
| 4,226,555 | * | 10/1980 | Bourne, Jr. et al. | 405/224 |
| 4,284,143 | * | 8/1981 | Scherrer et al. | 166/350 |
| 4,547,163 | * | 10/1985 | Langpaap et al. | 166/350 X |
| 4,762,180 | * | 8/1988 | Wybro et al. | 166/350 |
| 5,007,482 | * | 4/1991 | Forsyth et al. | 166/350 X |
| 5,044,826 | * | 9/1991 | Forster | 166/350 X |
| 5,288,253 | * | 2/1994 | Urdshals et al. | 166/350 X |

FOREIGN PATENT DOCUMENTS

| | | | |
|---|---|---|---|
| 2665725 | 4/1992 | (FR) . | |
| 9734074 | 9/1997 | (WO) | E21B/43/013 |

* cited by examiner

*Primary Examiner*—David Bagnell
*Assistant Examiner*—Tara L. Mayo
(74) *Attorney, Agent, or Firm*—Antonelli, Terry, Stout & Kraus, LLP

(57) ABSTRACT

The invention is a system used for production of petroleum effluents situated at great water depths. The system includes an intermediate floating station situated below the surface at a depth selected according to the pressure of the effluent at the outlet of wellheads situated on the station, production risers communicating with the well to be worked, an anchor including production risers, a pump situated on the floating station which transfers the effluent to a processing or destination site, a transfer which transfers the effluent between the floating station, the water bottom and a final platform or a processing plant, and an energy source providing necessary energy to the various equipments installed on the floating station.

43 Claims, 2 Drawing Sheets

MULTIPHASE PRODUCTION SYSTEM SUITED FOR GREAT WATER DEPTHS

BACKGROUND OF THE INVENTION

1. Field of the Invention

The invention relates to systems production of multiphase petroleum effluents situated offshore at great water depths.

2. Description of the Prior Art

Many petroleum production systems are described in the prior art.

French Patent 2,665,725 describes a multiphase production system suited for reservoirs with low production capacities, that are situated in moderately deep or shallow waters. The concept of this system is based on the use of a floating structure, readily movable and provided with the necessary equipments for transferring effluents from a well to the floating structure prior to sending them to a processing or storage site. Transfer of these effluents is performed without separation of their constituents. The anchoring ties of this buoy are flexible enough to allow to displace it readily from one reservoir to another.

In patent application PCT-NO97/00,068, a submersible floating buoy is anchored above a reservoir comprising several production wells. Anchoring of this buoy is achieved by means of production risers that extend between the floating buoy and the developed area of the reservoir. Production is fed into the production risers and carried to this submersible floating structure, then sent to a processing and production plant, floating or not, such as a converted tanker, or FPSO, where it is collected and processed in order to be carried to a point of destination and of use.

Although such a system decreases manufacturing cost by saving installing equipments on the sea bottom and by using the production risers as anchors, it however has certain drawbacks. In fact, the FPSO is suitable when the developed fields have low production capacities, but it becomes less profitable in the opposite case. Furthermore, although the buoy is situated at a depth selected to minimize the effects of the sea currents and of the wave motion, the influence of these two parameters produces relative motions of the FPSO in relation to the floating structure that can lead to stresses in the line used to transfer the effluents to the FPSO. Under certain conditions, such stresses can even result in breakage of these lines.

Moreover, in the case where the pressure of the reservoirs is low, bringing the effluents up to the surface can be difficult for great water depths, or even impossible if the reservoir pressure is insufficient, and the aforementioned system is ill-suited.

SUMMARY OF THE INVENTION

The present invention is a production system and its associated implementation method, capable of producing multiphase petroleum effluents that are at a low pressure either directly at the reservoir outlet or because they are produced from reservoirs situated at great water depths.

The production system according to the invention can also be used when the pressure of the reservoir is low, for example, in the final production phase of a well.

The invention also finds applications for production of offshore petroleum effluents, oil or gas recovery.

It comprises in combination the following elements:

a) an intermediate floating station situated below the surface at a depth selected according to the pressure of the effluent at the wellhead outlet, b) said floating station comprising one or more wellheads, each wellhead being connected to a production riser communicating with the well to be worked, c) an anchor which anchors said floating station, said anchor being the production risers, d) a pump situated on said floating station, said pump inporting a sufficient energy value to at least part of the effluent to ensure its transfer from said floating station to a processing or destination site, e) an effluent transfer means, said effluent transfer extending between the floating station, the sea bottom and a final platform or a processing plant, f) an energy source providing necessary energy for the various equipments installed on the floating station.

According to an embodiment, the pump is means one or more multiphase pumps and the effluent transfer means are, for example, one or more lines allowing to carry a multiphase effluent.

The intermediate floating station can comprise a separator which separates at least a fraction of the gas phase of the effluent and a transfer of the gaseous fraction to at least one of the wells.

The energy source can comprise a floating structure connected to the floating station by a multipurpose umbilical.

The floating station can comprise a separation device for separating at least a fraction of the gas phase of the effluent and a transfer of the gaseous fraction to a device generating electric power.

The floating station is for example situated at a depth of at least 100 m below the surface, but preferably between 150 and 300 m below the surface.

The system according to the invention can comprise several floating stations, each station being connected to at least part of an extensive reservoir (20) or to several reservoirs situated in a given area and supplying a common production center.

The system can also comprise one or more auxiliary pumps situated in one or more wells or in the vicinity of the sea bottom.

The production system according to the invention notably has the following advantages:

as transfer of the effluents up to the surface is no longer required, the range of workable reservoirs can be extended (possibility of producing low-pressure reservoirs), possibility of drilling or of carrying out repair and recompletion operations from the subsurface buoy, which does not require a drilling plant provided with equipments suited for deep-water work, the operating costs are decreased and maintenance operations are facilitated for the various equipments, the assembly of the intermediate buoy and of the service float can be reused.

BRIEF DESCRIPTION OF THE DRAWINGS

Other features and advantages of the device according to the invention will be clear from reading the description hereafter of a non limitative example, with reference to the accompanying drawings wherein.

DETAILED DESCRIPTION OF THE INVENTION

Figure 1:
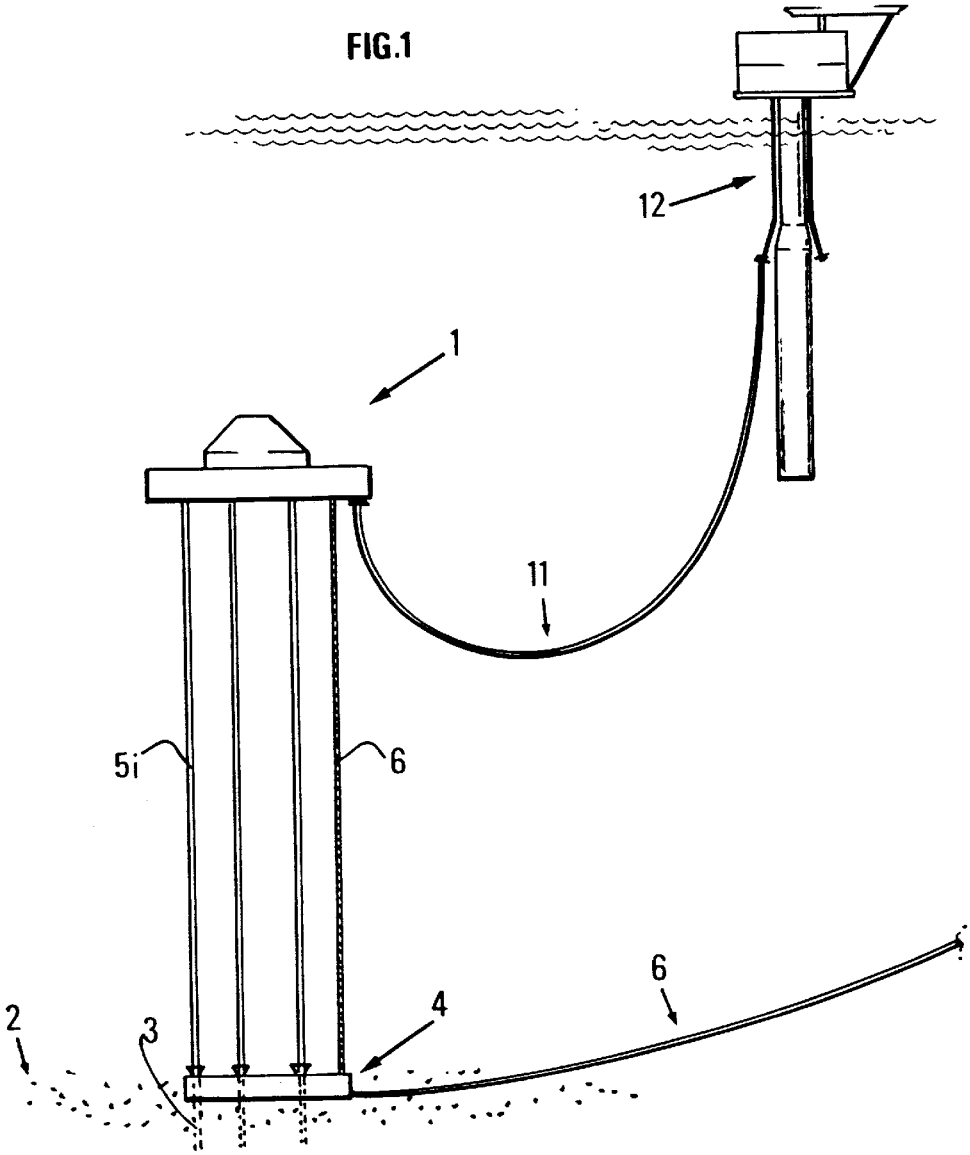
FIG. 1 shows an application of the invention for the equipment and development of a production field comprising several reservoirs situated at a great water depth.

FIG. 1 shows a possible example for implementation of a production system according to the invention when several reservoirs are situated at a relatively great water depth, ranging for example between 800 and 3000 m, preferably greater than 1000 m.

The production system comprises at least one submersible floating station 1 situated at a given water depth calculated from sea bottom 2. The station is anchored in the vicinity of an oil field comprising several wells 3, for example above. A production baseplate 4 through which run production risers 5*i* and an export riser 6 allowing the effluent to be sent to a destination or processing site is arranged in the vicinity of the field, the export riser being also connected to intermediate floating station 1.

Intermediate station 1 is, for example, a positive-buoyancy station providing tensioning of the production risers.

The production risers can be equipped with buoyancy producing elements distributed over all or part of the length thereof.

The well risers thus remain taut over the total length thereof when they are stressed during loading and whatever the stress they undergo.

The buoyancy producing elements can be air floats, syntactic foam floats or of any other positive-buoyancy material. The buoyancy will be fixed or possibly adjusted according to the various elements installed on the intermediate station.

According to a preferred embodiment, the floats are distributed among the various production risers and the subsurface station. The floats are so dimensioned that the fixed buoyancy of each production riser is at least equal to the weight of the production riser, of the equipments (by taking account of the wellheads, the manifold valves, possibly the tubings for example) and of the fluids circulating in the risers. The forces resulting from the hydrodynamic action of the marine elements and from the various stresses acting on the system can also be taken into account for dimensioning.

Figure 2:
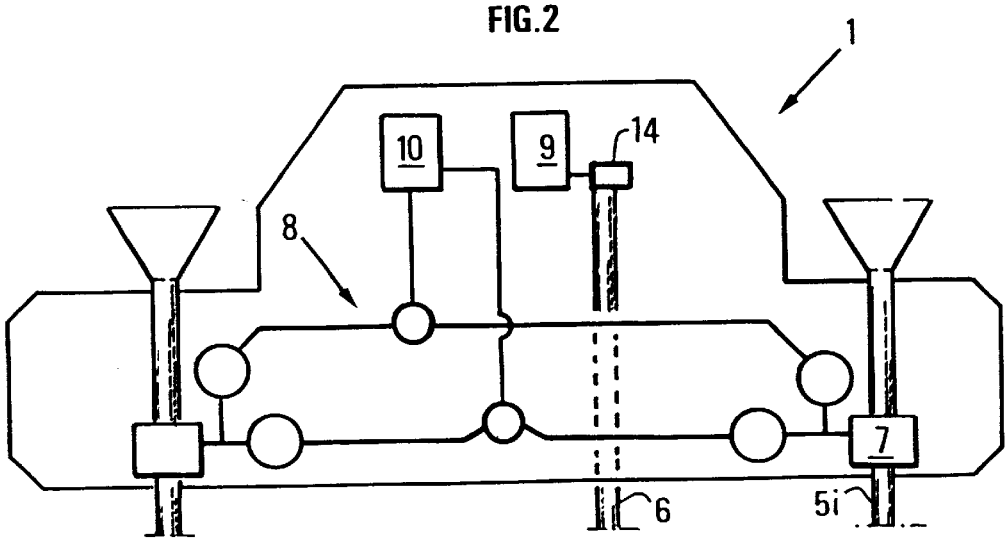
FIG. 2 shows in detail the immersed floating station with its equipments.

Wellheads 7 (FIG. 2), corresponding each to a production well and therefore to a production riser 5*i*, are situated on intermediate station 1. The latter can comprise a know manifold 8, notably intended for production gathering and well servicing.

Floating station 1 also comprises equipments more precisely suited for multiphase effluent pumping, such as a multiphase pumping system 9 and counting or flow metering equipment 10.

In some application instances, developed hereafter, it can comprise other elements.

The necessary energy for operation of the various equipments is provided by a multipurpose umbilical 11 connecting the station to a service float 12 situated in the vicinity of the floating station.

Service float 12 can be similar to that described in French Patent 2,710,946 of the assignee.

Service float 12 comprises for example the auxiliary equipments required for power supply, for example a transformer if necessary.

Service float 12 can comprise all the storage for storing and injectors for injecting chemicals preventing formation of hydrates and of other deposits, as well as corrosion preventive chemicals. Injection can be performed by umbilical 11.

Service float 12 comprises for example the equipments required to send scrapers through export pipe 6 by means of a flexible riser.

The service float is equipped with equipment providing at least the following functions: energy generation, injection of chemicals, possible injection of water into the wells, control of the implementation of scrapers and of their return to the service float, control and telemetry. The various elements being known, they are not detailed here.

A possible way to develop a multiple reservoir comprising several wells situated at a great water depth by implementing the system described above can comprise the following stages:

a) positioning the intermediate floating station or buoy above the reservoir field, using the production risers as anchors, b) leading the petroleum effluents from one or more wells up to the wellhead(s) situated on the floating structure; production can be simultaneous from all the wellheads or sequential, all of the effluents being in any case collected together through the manifold, c) transferring the effluents from the wellheads, using the multiphase pump situated on the intermediate buoy, and through the export riser extending between this buoy and the sea bottom; transfer is performed without taking the effluents up to the surface.

Stages b) and c) can be performed simultaneously.

When positioning the buoy at stage a), the value of the depth of immersion of the floating station is a compromise taking notably account of:

the exposure to the motion resulting from the swells when the station is too close to the surface, the hydrostatic pressure that requires equipments suited to withstand high pressures when situated in the vicinity of the sea bottom, the pressure determined near wellhead 7, that must be higher than the intake pressure tolerated by the pump.

The floating station is for example situated at a depth of at least 100 m below the surface, but preferably between 150 and 300 m below the surface.

The additional pressure value to be applied to the effluents in order to take them to the surface is thus decreased, unlike the systems of the prior art.

Without departing from the scope of the invention, the floating station can be a simple positive-buoyancy submersible buoy.

During all the production stages, the energy required for operation is transferred through a multipurpose umbilical 11 from a main platform situated at a distance from the floating station or from an onshore installation.

This energy can be electric or hydraulic when the distance between the service float and the intermediate buoy is not too great.

A way to produce the energy required for operation of the system uses part of the gas phase of the effluent produced. To that end, the intermediate floating station is equipped with means separator 14 which separates at least a fraction of the gas phase. The gaseous fraction is sent by its own pressure to a gas turbine situated on the service float in order to produce energy. This energy can be electric or hydraulic. Transfer of the gas to the float can be performed by means of multipurpose umbilical 11 or through a line parallel to the umbilical, situated between floating station 1 and service float 12 for example.

In the case where the effluents produced comprise a certain amount of water, for example when the production of water is above 30%, the intermediate floating station can comprise equipments suited to separate the water, to reinject this separated and recovered water into one or more wells. The water will be separated totally or partly according to the initial amount and to its final use. The equipments required for water reinjection are situated in the vicinity of the service float, as mentioned above, or of the subsurface station.

On the intermediate floating station, a fraction of the gas can be separated in order to be reinjected into one or more wells so as to improve recovery of the effluent (enhanced recovery). To that end, the buoy is provided with one or more pipes connected to separator 14 and opening into the wells, as well as suitable compression elements intended for reinjection. In the service float, the gas is for example dried according to a known process and brought to the required conditions by the gas turbine supplying the electric power.

Without departing from the scope of the invention, the production risers can be surrounded by conductor pipes conventionally used during well drilling operations.

The multiphase pumps arranged on the intermediate buoy receive the energy thus generated, either in the form of electric energy via the multipurpose umbilical or in the form of pressurized water that drives then a hydraulic turbine, the turbine being for example situated above the multiphase pump.

All the elements that make up the multiphase pumping system are installed on the upper deck of floating station 1. They are for example protected by a stiff hood open on the top in order to allow access to the production modules. These modules can be raised by a known service support.

The system described above is applied for example to production of fields with high production capacities but also short lives of the order of 2 to 5 years. It notably affords the advantage of being a light equipment.

Without departing from the scope of the invention, several production systems can be arranged in the vicinity of an extensive field comprising several deviated wells for which deviation is insufficient to reach all the parts of the reservoir from a single drilling center, according to a conventional pattern.

This is notably the case when the depth of the reservoir is too low and its horizontal extent too great to be able to reach all the parts of the reservoir by deviating the wells sufficiently or by drilling horizontal wells.

Figure 3:
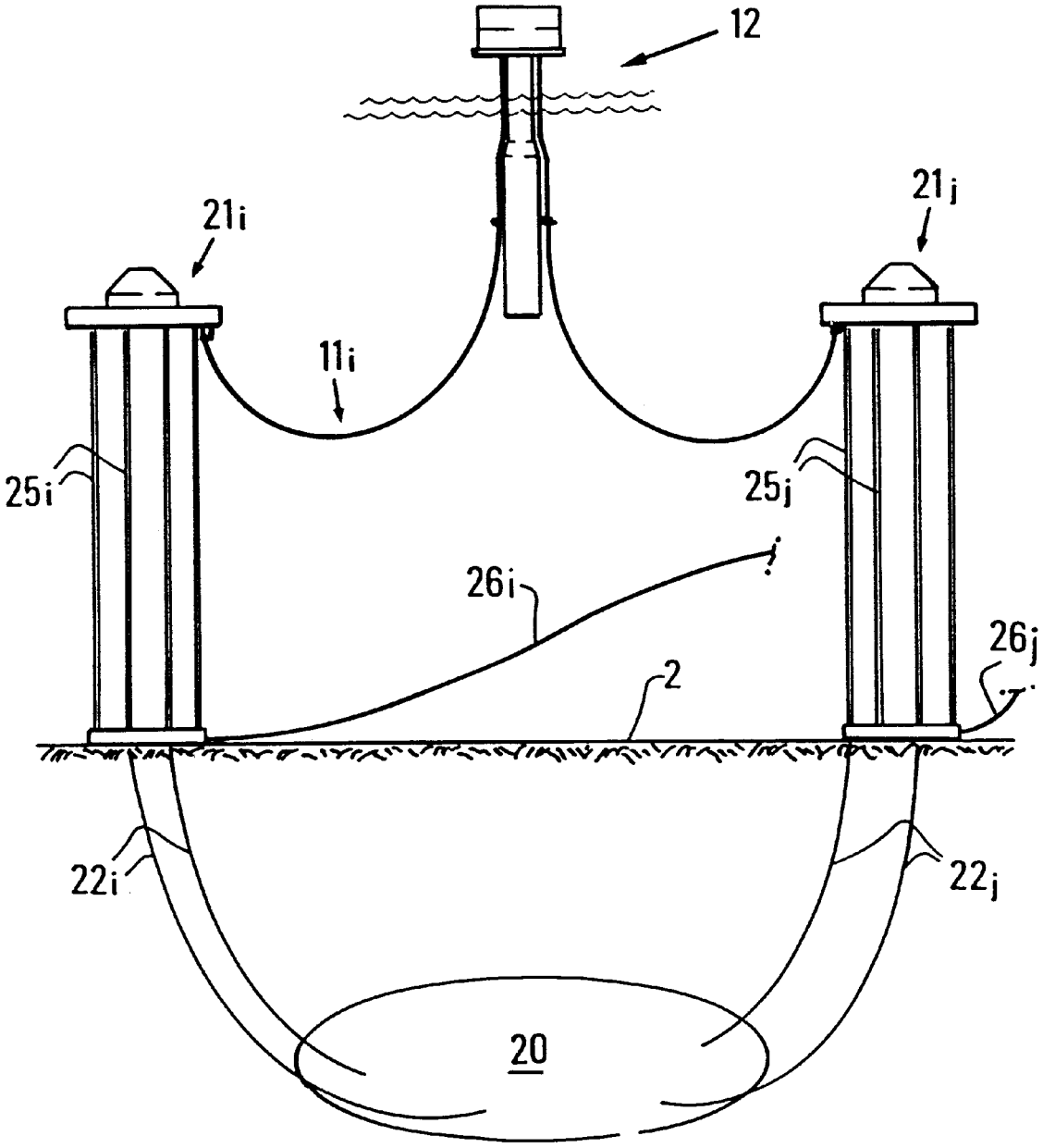
FIG. 3 shows an application of the system according to the invention for reservoir development from deviated wells communicating with a single reservoir.

FIG. 3 schematizes an example of a layout where a reservoir 20 is worked by several floating stations, 21*i* and 21*j* in this example, that are connected to a service float 12 which supplies the necessary energy as shown in FIG. 1, by means of umbilicals 11*i*, 11*j*.

The number and the location of floating stations 21*i*, 21*j* are so determined that all the wells 22*i*, 22*j* connected to floating stations 21*i*, 21*j* by means of production risers 25*i*, 25*j* can drain the whole reservoir. Dimensioning can be achieved by known methods.

Each intermediate floating station 21*i*, 21*j* is connected to a production center or to a processing platform (not shown in the figure) by means of a feeder 26*i*, 26*j* that comes down to sea bottom 2.

The production center can be a floating unit such as a ship or a semisubmersible platform.

Without departing from the scope of the invention, the production center can also be a system similar to that of the invention, with producing wells or not. The center is used for example for gathering the effluents produced and for sending them to a receiving center situated at a greater distance.

According to another embodiment of the system according to the invention, the floating station used to work a first reservoir can also be used for working a satellite reservoir situated at a distance from the first reservoir. In this case, the distance between the satellite reservoir and the initial floating station can range from a few kilometres to about twenty kilometres.

The system according to the invention also finds application for working low-pressure pressure wells.

According to another embodiment more specially suited when the wells have a low pressure value or when the value of this pressure and the water depth are great, it will be possible to position an auxiliary pump, for example, at the foot of the production riser or in the vicinity of the well. This auxiliary pump is selected so as to impart to the effluent a sufficient pressure allowing to drive it up to at least the intermediate buoy. The effluent is then compressed by the multiphase pumping system which can comprise one or more pumps arranged in parallel or in series.

Without departing from the scope of the invention, the system can be used for deep zones subjected to turbidity currents formed by crumbling of unstable sediments for which installing active development equipments on the sea bottom cannot be envisaged.

What is claimed is:

1. A system for underwater production of effluents comprising:

a) a floating station situated below the water surface at a depth selected according to at least a pressure of an effluent at at least one wellhead outlet;

(b) the floating station comprising at least one wellhead, each wellhead being connected to a production riser communicating with a well to be worked;

(c) an anchor which anchors the floating station, the anchor being at least one production riser;

(d) at least one multiphase pump situated on the floating station, the at least one multiphase pump transferring at least part of an effluent from the floating station to one of a processing site or destination site;

(e) an effluent transfer, the effluent transfer extending between the floating station, water bottom and one of the platform or the processing site; and (f) an energy source providing energy for equipment on the floating station.

2. A system as claimed in claim 1, wherein:

the effluent transfer is at least one pipe which carries the effluent.

3. A system as claimed in claim 2, wherein:

the energy source is a floating structure connected to the floating station by an umbilical.

4. A system as claimed in claim 3, wherein:

floating station comprises a separator which separates at least a fraction of a gas phase of the effluent and transfers the separated fraction to an electrical generator.

5. A system as claimed in claim 4, wherein:

the floating station is situated at a depth of at least 100 m below the water surface.

6. A system as claimed in claim 5, further comprising:

at least one additional floating station situated below the water surface at a depth selected according to at least a pressure of an effluent at at least one wellhead outlet, each floating station being connected to at least part of at least one reservoir which supplies a production center.

7. A system as claimed in claim 4, further comprising:

at least one additional floating station situated below the water surface at a depth selected according to at least a pressure of an effluent at at least one wellhead outlet, each floating station being connected to at least part of at least one reservoir which supplies a production center.

8. A system as claimed in claim 3, further comprising:

at least one additional floating station situated below the water surface at a depth selected according to at least a pressure of an effluent at at least one wellhead outlet, each floating station being connected to at least part of at least one reservoir which supplies a production center.

9. A system as claimed in claim 2, wherein:

the floating station comprises a separator which separates at least a fraction of a gas phase of the effluent and transfers the separated fraction to an electrical generator.

10. A system as claimed in claim 9, wherein:

the floating station is situated at a depth of at least 100 m below the water surface.

11. A system as claimed in claim 10, further comprising:

at least one additional floating station situated below the water surface at a depth selected according to at least a pressure of an effluent at at least one wellhead outlet, each floating station being connected to at least part of at least one reservoir which supplies a production center.

12. A system as claimed in claim 9, further comprising:

at least one additional floating station situated below the water surface at a depth selected according to at least a pressure of an effluent at at least one wellhead outlet, each floating station being connected to at least part of at least one reservoir which supplies a production center.

13. A system as claimed in claim 2, further comprising:

at least one additional floating station situated below the water surface at a depth selected according to at least a pressure of an effluent at at least one wellhead outlet, each floating station being connected to at least part of at least one reservoir which supplies a production center.

14. A system as claimed in claim 1, wherein:

the floating station comprises a separator which separates at least a fraction of a gas phase of the effluent and transfers the separated fraction to at least one well.

15. A system as claimed in claim 14, wherein:

the energy source is a floating structure connected to the floating station by an umbilical.

16. A system as claimed in claim 15, wherein:

the floating station comprises a separator which separates at least a fraction of a gas phase of the effluent which transfers the separated fraction to an electrical generator.

17. A system as claimed in claim 16, wherein:

the floating station is situated at a depth of at least 100 m below the water surface.

18. A system as claimed in claim 17, further comprising:

at least one additional floating station situated below the water surface at a depth selected according to at least a pressure of an effluent at at least one wellhead outlet, each floating station being connected to at least part of at least one reservoir which supplies a production center.

19. A system as claimed in claim 16, further comprising:

at least one additional floating station situated below the water surface at a depth selected according to at least a pressure of an effluent at at least one wellhead outlet, each floating station being connected to at least part of at least one reservoir which supplies a production center.

20. A system as claimed in claim 15, further comprising:

at least one additional floating station situated below the water surface at a depth selected according to at least a pressure of an effluent at at least one wellhead outlet, each floating station being connected to at least part of at least one reservoir which supplies a production center.

21. A system as claimed in claim 14, wherein:

the floating station comprises a separator which separates at least a fraction of a gas phase of the effluent which transfers the separated fraction to an electrical generator.

22. A system as claimed in claim 21, wherein:

the floating station is situated at a depth of at least 100 m below the water surface.

23. A system as claimed in claim 22, further comprising:

at least one additional floating station situated below the water surface at a depth selected according to at least a pressure of an effluent at at least one wellhead outlet, each floating station being connected to at least part of at least one reservoir which supplies a production center.

24. A system as claimed in claim 21, further comprising:

at least one additional floating station situated below the water surface at a depth selected according to at least a pressure of an effluent at at least one wellhead outlet, each floating station being connected to at least part of at least one reservoir which supplies a production center.

25. A system as claimed in claim 14, further comprising:

at least one additional floating station situated below the water surface at a depth selected according to at least a pressure of an effluent at at least one wellhead outlet, each floating station being connected to at least part of at least one reservoir which supplies a production center.

26. A system as claimed in claim 1, wherein:

the energy source is a floating structure connected to the floating station by an umbilical.

27. A system as claimed in claim 26, wherein:

the floating station comprises a separator which separates at least a fraction of a gas phase of the effluent and transfers the separated fraction to an electrical generator.

28. A system as claimed in claim 27, wherein:

the floating station is situated at a depth of at least 100 m below the water surface.

29. A system as claimed in claim 28, further comprising:

at least one additional floating station situated below the water surface at a depth selected according to at least a pressure of an effluent at at least one wellhead outlet, each floating station being connected to at least part of at least one reservoir which supplies a production center.

30. A system as claimed in claim 27, further comprising:

at least one additional floating station situated below the water surface at a depth selected according to at least a pressure of an effluent at at least one wellhead outlet, each floating station being connected to at least part of at least one reservoir which supplies a production center.

31. A system as claimed in claim 26, further comprising:

at least one additional floating station situated below the water surface at a depth selected according to at least a pressure of an effluent at at least one wellhead outlet, each floating station being connected to at least part of at least one reservoir which supplies a production center.

32. A system as claimed in claim 1, wherein:

the floating station comprises a separator which separates at least a fraction of a gas phase of the effluent and transfers the separated fraction to an electrical generator.

33. A system as claimed in claim 32, wherein:

the floating station comprises a separator which separates at least a fraction of a gas phase of the effluent and transfers the separated fraction to an electrical generator.

34. A system as claimed in claim 33, wherein:

the floating station is situated at a depth of at least 100 m below the water surface.

35. A system as claimed in claim 34, further comprising:

at least one additional floating station situated below the water surface at a depth selected according to at least a pressure of an effluent at least one wellhead outlet, each floating station being connected to at least part of at least one reservoir which supplies a production center.

36. A system as claimed in claim 33, further comprising:

at least one additional floating station situated below the water surface at a depth selected according to at least a pressure of an effluent at at least one wellhead outlet, each floating station being connected to at least part of at least one reservoir which supplies a production center.

37. A system as claimed in claim 32, further comprising:

at least one additional floating station situated below the water surface at a depth selected according to at least a pressure of an effluent at at least one wellhead outlet, each floating station being connected to at least part of at least one reservoir which supplies a production center.

38. A system as claimed in claim 1, wherein:

the floating station is situated at a depth of at least 100 m below the water surface.

39. A system in accordance with claim 38 wherein:

the floating station is situated between 150 and 300 m below the water surface.

40. A system as claimed in claim 39, further comprising:

at least one additional floating station situated below the water surface at a depth selected according to at least a pressure of an effluent at at least one wellhead outlet, each floating station being connected to at least part of at least one reservoir which supplies a production center.

41. A system as claimed in claim 38, further comprising:

at least one additional floating station situated below the water surface at a depth selected according to at least a pressure of an effluent at at least one wellhead outlet, each floating station being connected to at least part of at least one reservoir which supplies a production center.

42. A system as claimed in claim 1, further comprising:

a plurality of floating stations, each floating station being connected to at least part of at least one reservoir which supplies a production center.

43. A system as claimed in claim 1, comprising:

at least one auxiliary pump located in at least one said well or in proximity to the water bottom.

* * * * *